US006210253B1

(12) United States Patent
Sammons

(10) Patent No.: US 6,210,253 B1
(45) Date of Patent: Apr. 3, 2001

(54) LONGITUDINALLY FINISHED SHOTGUN BARREL AND METHOD THEREFOR

(76) Inventor: Hal C. Sammons, Rte. 3, Box 784, Tahlequah, OK (US) 74464

( * ) Notice: Subject to any disclaimer, the term of this patent is extended or adjusted under 35 U.S.C. 154(b) by 0 days.

(21) Appl. No.: 09/288,171

(22) Filed: Apr. 8, 1999

(51) Int. Cl.[7] ..... B24B 1/00

(52) U.S. Cl. ..... 451/36; 451/51; 42/95; 42/76.01

(58) Field of Search ..... 451/64, 36, 37, 451/51, 61; 42/79

(56) References Cited

U.S. PATENT DOCUMENTS

| | | | | |
|---|---|---|---|---|
| 2,298,775 | * | 10/1942 | Raiche | 451/164 |
| 3,634,973 | * | 1/1972 | McCarty | 451/64 |
| 3,699,725 | * | 10/1972 | Feldcamp | 451/61 |
| 5,203,883 | * | 4/1993 | Perry | 451/36 |
| 5,378,499 | * | 1/1995 | Martin et al. | 427/242 |
| 6,112,447 | * | 9/2000 | Androsov | 42/79 |

* cited by examiner

*Primary Examiner*—Robert A. Rose

(74) *Attorney, Agent, or Firm*—Frank J. Catalano

(57) ABSTRACT

A method for refinishing the bore of a shotgun barrel achieves high finish surface grades by pumping a relatively soft abrasive media longitudinally through the bore. The resulting bore striations are oriented in a longitudinal direction along the barrel, significantly reducing the felt recoil and increasing the muzzle velocity of the weapon. The gunsmith swabs the bore to remove dust. The bore is inspected to detect obstructions and blemishes and then secured to a support structure in a horizontal orientation. The grade of the surface finish of the bore is determined. A polishing media pumping system is connected to the receiver end of the barrel and all holes through the barrel wall are blocked. A silicone matrix media impregnated with silicon carbide is pumped from the receiver end of the barrel through the bore and out the muzzle end of the barrel to polish the bore until the bore striations are generally longitudinal. The barrel is disconnected from the pumping system and the support structure and excess media cleaned out of the bore. All blocking materials are removed from the barrel and air blown through the bore to clean out residue. A liquid cleaner is applied to the bore to remove oils and the like and the bore is swabbed. The grade of the surface finish of the polished bore is determined. If necessary, the barrel is resecured to the support structure and the previous steps repeated as necessary.

10 Claims, 4 Drawing Sheets

LONGITUDINALLY FINISHED SHOTGUN BARREL AND METHOD THEREFOR

BACKGROUND OF THE INVENTION

This invention relates generally to shotguns and more particularly concerns the finish of the bore of a shotgun barrel.

Shotgun barrel bores are now generally "hone" finished to an approximately Ra 15 to Ra 17 surface grade with resulting striations oriented in a generally rotational direction in the bore. Since the striations are transverse to the path of shot and gasses traveling in the barrel, the shotgun demonstrates greater recoil and lower muzzle velocity than could have been achieved if the striations were not present.

It is, therefore, an object of this invention to provide a shotgun barrel having a bore which is striated in a generally longitudinal direction along the barrel. Another object of this invention is to provide a shotgun barrel having a bore finish that minimizes recoil of the weapon. A further object of this invention is to provide a shotgun barrel having a bore finish that maximizes the muzzle velocity of the weapon. It is also an object of this invention to provide a method for polishing the bore of a shotgun barrel to a high surface grade in comparison to the finishes achieved by conventional "hone" finishing methods. Yet another object of this invention is to provide a method for polishing the bore of a shotgun barrel which results in minimizing non-longitudinal striations on the bore surface. And it is an object of this invention to provide a method for polishing the bore of a shotgun barrel which results in generally longitudinal striations on the bore surface.

SUMMARY OF THE INVENTION

In accordance with the invention, a method is provided for refinishing the bore of a shotgun barrel by pumping a relatively soft abrasive media longitudinally through the bore, thus achieving a higher surface grade. Use of the method further results in the bore having striations oriented in a longitudinal direction along the barrel. Since the striations are along the path of the shot and gasses which travel in the barrel, significant reduction in the felt recoil and increase in the muzzle velocity of the weapon is achieved.

In practicing the method for finishing the shotgun barrel, the gunsmith swabs the bore to remove dust. The bore is inspected to detect obstructions and blemishes and then secured to a support structure in a horizontal orientation. The grade of the surface finish of the bore is determined. A polishing media pumping system is connected to the receiver end of the barrel and all holes through the barrel wall are blocked. A silicone matrix media impregnated with silicon carbide is pumped from the receiver end of the barrel through the bore and out the muzzle end of the barrel to polish the bore until the bore striations are generally longitudinal. The barrel is disconnected from the pumping system and the support structure and excess media cleaned out of the bore. All blocking materials are removed from the barrel and air blown through the bore to clean out residue. A liquid cleaner is applied to the bore to remove oils and the like and the bore is swabbed. The grade of the surface finish of the polished bore is determined. If necessary, the barrel is resecured to the support structure and the previous steps repeated as necessary until a satisfactory grade of surface finish is achieved.

BRIEF DESCRIPTION OF THE DRAWINGS

Other objects and advantages of the invention will become apparent upon reading the following detailed description and upon reference to the drawings in which.

While the invention will be described in connection with a preferred embodiment and method, it will be understood that it is not intended to limit the invention to that embodiment and method. On the contrary, it is intended to cover all alternatives, modifications and equivalents as may be included within the spirit and scope of the invention as defined by the appended claims.

DETAILED DESCRIPTION OF THE INVENTION

Figure 1:
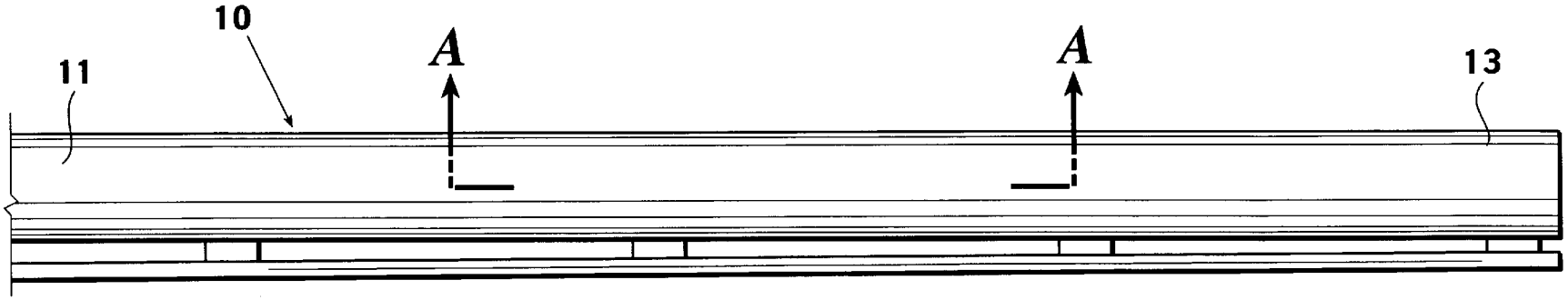
FIG. 1 is a side elevation view of the muzzle end of a typical shotgun barrel.

Turning first to FIG. 1, the outer surface of a typical shotgun barrel 10 is illustrated. The barrel 10 extends from the chamber end 11 to the muzzle end 13.

Figure 2:
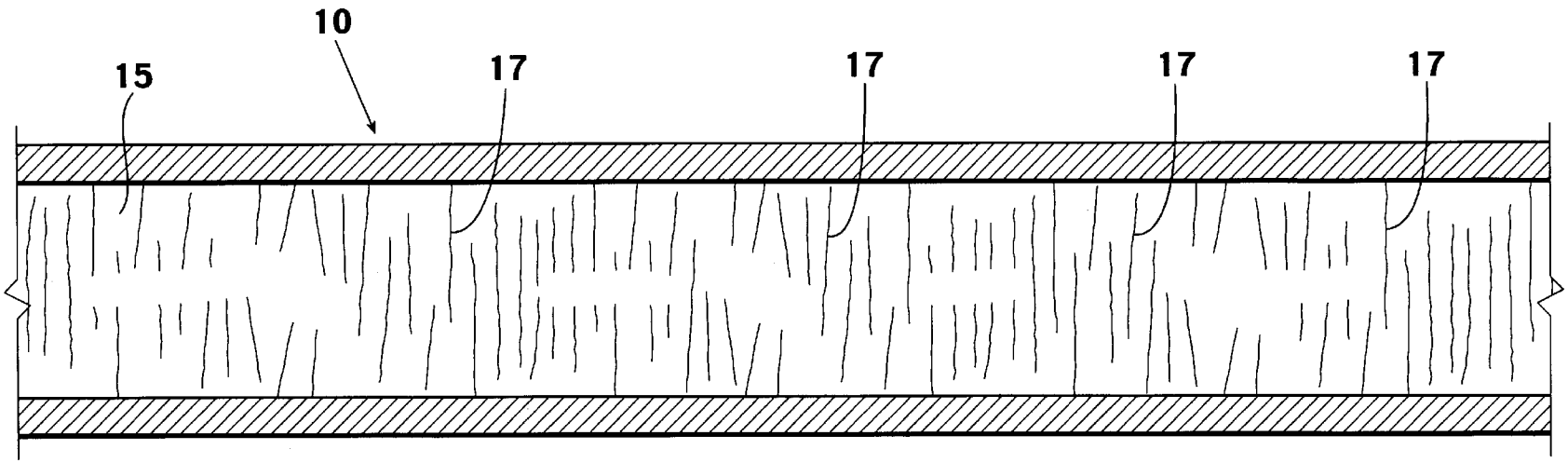
FIG. 2 is a partial longitudinal, diametric cross-section taken along the line A—A of FIG. 1 before the bore has been finished in accordance with the method of the present invention.

The bore 15 of the barrel 10 in the typical condition as received from the factory or after refinishing by conventional "hone" methods, is illustrated in FIG. 2. As shown, the manufacturing and/or refinishing process results in generally rotational striations 17 in the surface of the bore 15. By "generally rotational," it is meant that the streaks or furrows of the striation 17 are not necessarily parallel or straight, but are closer to perpendicular to the longitudinal axis of the bore 15 than parallel to it. Since these striations 17 are, for the most part, transverse to the path of the shot and gasses exiting the weapon, they tend to increase the recoil and decrease the muzzle velocity of the shotgun. The rotational striations 17 are the result of use of machining and polishing tools which operate in rotational fashion. A more highly polished surface on the bore 15 will result in finer striations 17. However, the finest finishes achieved with known methods are in the order of Ra 13 to Ra 15 micro inches.

Figure 3:
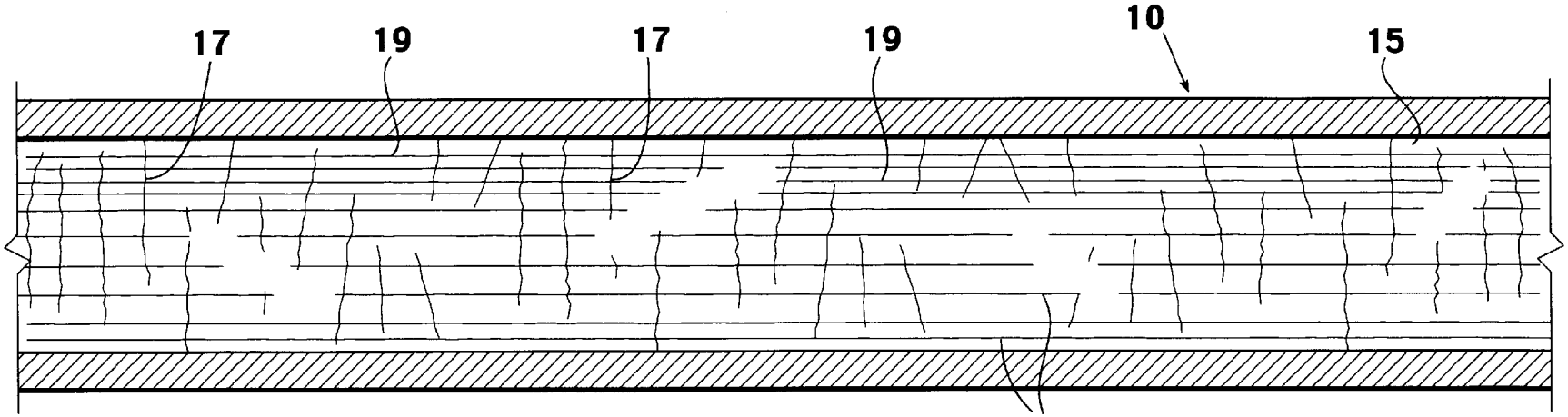
FIG. 3 is a partial longitudinal, diametric cross-section taken along the line A—A of FIG. 1 after the bore has been finished to an intermediate surface grade in accordance with the method of the present invention.
Figure 4:
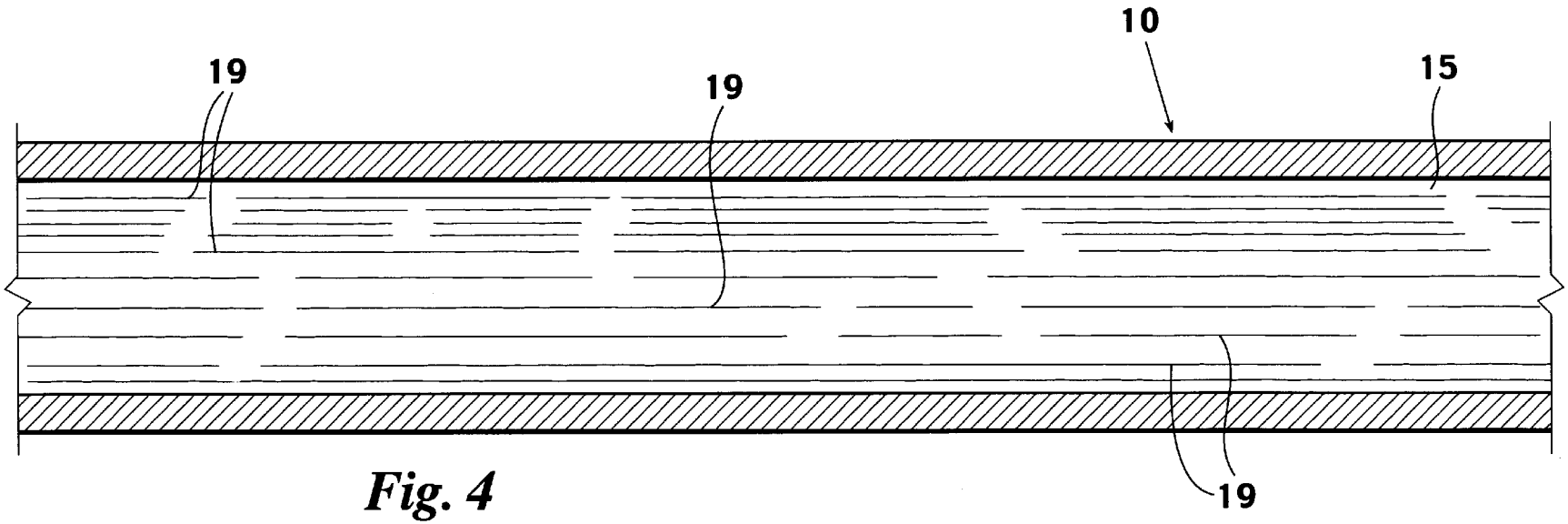
FIG. 4 is a partial longitudinal, diametric cross-section taken along the line A—A of FIG. 1 after the bore has been finished to a final surface grade in accordance with the method of the present invention.
Figure 5:
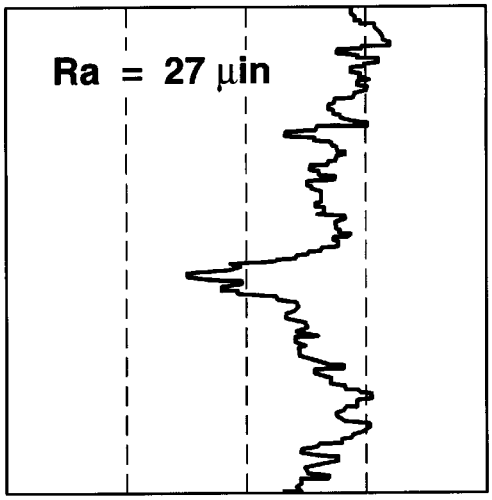
FIG. 5 is a graphic representation of the surface grade of the bore as shown in FIG. 2.
Figure 6:
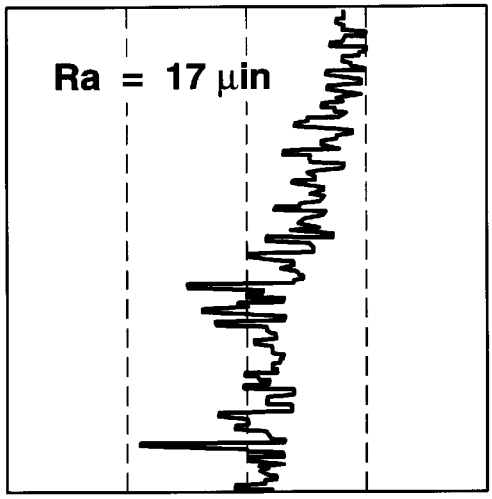
FIG. 6 is a graphic representation of the surface grade of the bore as shown in FIG. 3.
Figure 7:
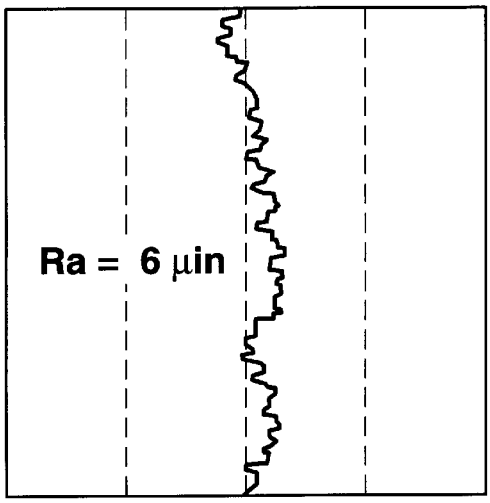
FIG. 7 is a graphic representation of the surface grade of the bore as shown in FIG. 4.

The present method avoids the use of rotational tools in polishing. A relatively soft abrasive media is pumped longitudinally through the bore 15 to provide generally longitudinal striations in the bore 15 which in turn facilitate the passage of shot and gasses through the bore 15. Looking at FIG. 3, after the present method has been used for an interval of time, the rotational striations 17 are reduced in number and depth and longitudinal striations 19 begin to appear in the surface of the bore 15. Looking at FIG. 4, as the method is continued for a longer interval, the rotational striations 17 are substantially removed and the surface of the bore 15 is characterized by generally longitudinal striations 19. By generally longitudinal striations, it is meant that the streaks or furrows of the striations 19 are not necessarily absolutely parallel to each other or straight, but are closer to parallel to the longitudinal axis of the bore 15 than perpendicular to it. The surface grades Ra of the bore 15 at the stages of the method illustrated in FIGS. 2, 3 and 4 are generally illustrated in FIGS. 5, 6 and 7, respectively. As shown, the factory or conventional refinishing grade Ra of the barrel 10 used was, as an example, 27 micro inches. At the intermediate stage of the present method in which both rotational and longitudinal striations 17 and 19 appear, the surface grade Ra has been improved to 17 micro inches. At the final stage exhibiting substantially only longitudinal striations 19, the surface grade Ra has been improved to 6 micro inches. Thus, the bore 15 has been polished to a much finer finish than was typically achieved by old polishing methods and, furthermore, the direction of the striations has been radically and favorably altered.

Figure 8:
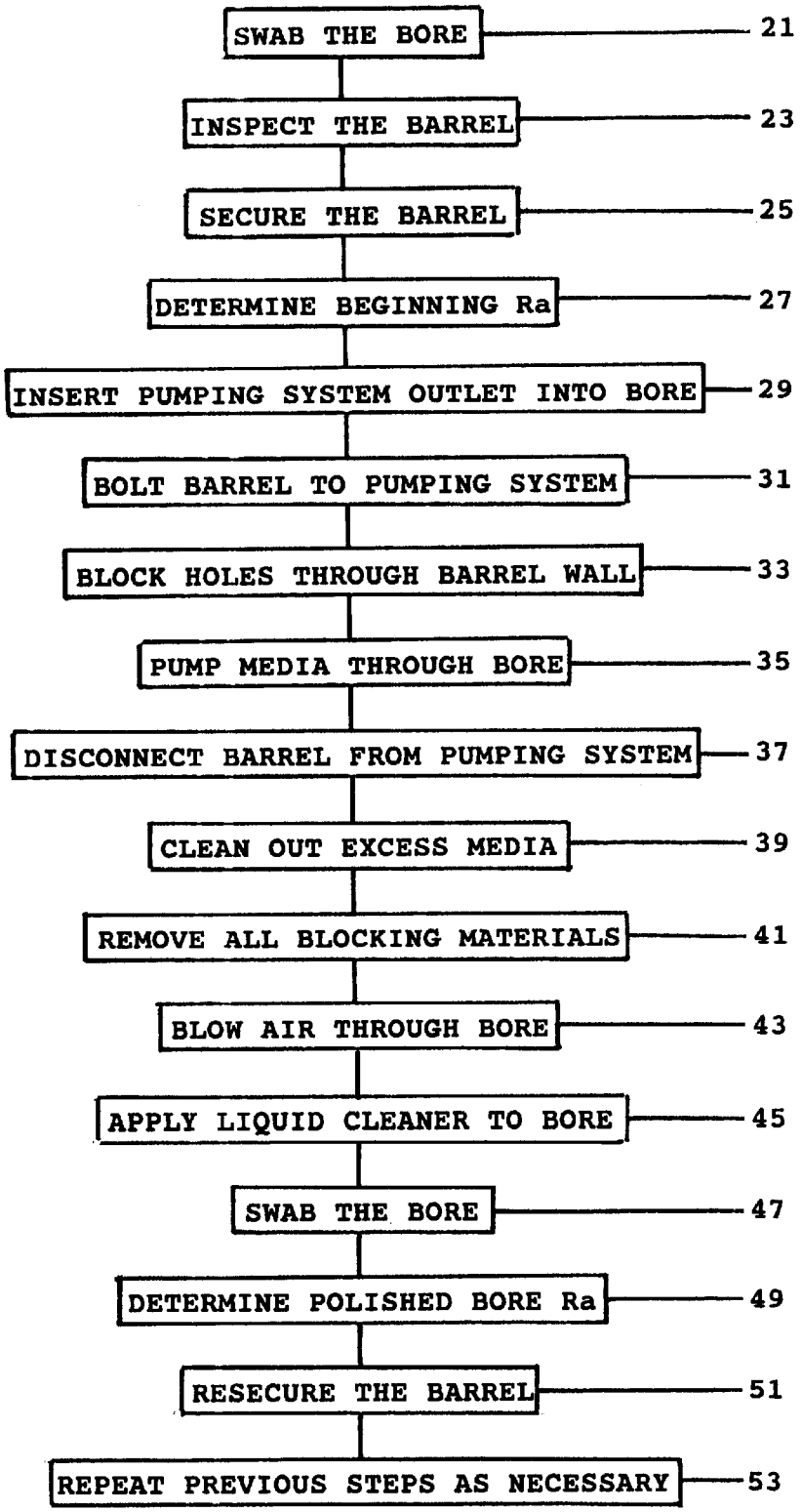
FIG. 8 is a flow diagram illustrating the steps of method of the present invention.

In the practice of the method of the invention, as is illustrated in FIG. 8. The bore is swabbed 21 to remove dust. The gunsmith inspects 23 the barrel, including the housing, back bore, thread and choke, for obstructions and/or blemishes, perhaps by use of fiber optics or borescope. The inspected barrel is secured 25 in a horizontal orientation, preferably on a table using a granite surface plate with padded V-blocks. The grade of the surface finish Ra of the bore is then determined 27, perhaps by use of a profilometer which reads the height or depth of the ridges or valleys of the striations in micro inches. An Ra greater than 13 has, in accordance with previously known polishing standards, been deemed unsatisfactory. The outlet of a polishing media pumping system is inserted 29 into the receiver end of the barrel. Approximately 5/16 inch penetration will satisfactorily align the barrel and the media pumping system. The barrel is then bolted 31 to the pumping system. All holes through the barrel wall are blocked 33, preferably using nylon blocks and tape. A silicone matrix media impregnated with silicon carbide is pumped 35 from the receiver end of the barrel through the bore and out the muzzle end of the barrel. A low to medium viscosity grade of media such as LMV-220 by Extrude Home Corporation of Erwin, Pa. is preferred. The barrel is then disconnected 37 from the pumping system. Excess media is cleaned 39 out of the bore, preferably by use of a nylon probe. All blocking materials are removed 41 from the barrel. Air is blown 43 through the bore to clean out residue. A liquid cleaner is applied 45 to the bore to remove oils and the like. "Gun Scrub" works effectively for this purpose. The bore is swabbed 47 again. The grade Ra of the surface finish of the polished bore is determined 49. As before, this can be done by use of a profilometer to read the height or depth of the ridges or valleys of the striations in micro inches. A surface grade Ra less than 8 is generally satisfactory. The barrel is resecured 51 in its horizontal orientation. The previous steps are repeated 53 as necessary until a satisfactory grade of surface finish is achieved. The gunsmith then cleans and oils the bore and returns the barrel with the surface grade data to the shotgun owner.

A typical shotgun barrel has a chamber diameter of approximately 0.80", an average bore diameter of approximately 0.73" and a muzzle diameter of approximately 0.69". Since the barrel tapers narrowingly toward the muzzle, the media is compressed as it passes through the bore. If, in the preparatory steps prior to pumping 35, the bore is adequately cleaned, the media can be recycled to its reservoir for reuse.

Finish grades in the order of Ra5 to Ra7 have been readily achieved using this method. This method has, for example, also resulted in increasing the muzzle velocity of a weapon from 1200 ft/sec prior to refinishing to over 1400 ft/sec after refinishing depending on the actual bore diameter, surface finish, ammunition and temperature.

Thus, it is apparent that there has been provided, in accordance with the invention, a shotgun barrel and method of polishing it that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method for finishing a tapered shotgun barrel comprising pumping a silicone matrix media impregnated with silicon carbide from the receiver end of the barrel through the bore and out the muzzle end of the barrel to provide generally longitudinal gas transferring striations in the bore.

2. A method for finishing a tapered shotgun barrel comprising the steps of:

securing the barrel to a support structure in a horizontal orientation;

connecting a polishing media pumping system to the receiver end of the barrel;

blocking all holes through the barrel wall;

pumping a silicone matrix media impregnated with silicon carbide from the receiver end of the barrel through the bore and out the muzzle end of the barrel to polish the bore until the bore has generally longitudinal gas transferring striations;

disconnecting the barrel from the pumping system and the support structure; and removing all blocking materials from the barrel.

3. A method for finishing a tapered shotgun barrel comprising the steps of:

securing the barrel to a support structure in a horizontal orientation;

connecting a polishing media pumping system to the receiver end of the barrel;

blocking all holes through the barrel wall;

pumping a silicone matrix media impregnated with silicon carbide from the receiver end of the barrel through the bore and out the muzzle end of the barrel to polish the bore until the bore striations are generally longitudinal;

disconnecting the barrel from the pumping system and the support structure; and removing all blocking materials from the barrel;

blowing air through the bore to eject residue;

applying a liquid cleaner to the blown bore to remove oils and the like;

swabbing the bore; and inspecting the bore Ra surface finish.

4. A method according to claim 3 further comprising the steps of:

determining the grade of the surface finish of the polished bore;

resecuring the barrel to the support structure; and repeating the previous steps as necessary until a satisfactory grade of surface finish is achieved.

5. A method for finishing a tapered shotgun barrel comprising the steps of:

securing the barrel to a support structure in a horizontal orientation;

connecting a polishing media pumping system to the receiver end of the barrel;

blocking all holes through the barrel wall;

pumping a silicone matrix media impregnated with silicon carbide from the receiver end of the barrel through the bore and out the muzzle end of the barrel to polish the bore until the bore has generally longitudinal gas transferring striations;

disconnecting the barrel from the pumping system and the support structure;

cleaning excess media out of the bore; and removing all blocking materials from the barrel.

6. A method for finishing a tapered shotgun barrel comprising the steps of:

securing the barrel to a support structure in a horizontal orientation;

connecting a polishing media pumping system to the receiver end of the barrel;

blocking all holes through the barrel wall;

pumping a silicone matrix media impregnated with silicon carbide from the receiver end of the barrel through the bore and out the muzzle end of the barrel to polish the bore until the bore striations are generally longitudinal;

disconnecting the barrel from the pumping system and the support structure;

cleaning excess media out of the bore;

removing all blocking materials from the barrel;

blowing air through the bore to eject residue;

applying a liquid cleaner to the blown bore to remove oils and the like;

swabbing the bore; and inspecting the bore Ra surface finish.

7. A method according to claim 6 further comprising the steps of:

determining the grade of the surface finish of the polished bore;

resecuring the barrel to the support structure; and repeating the previous steps as necessary until a satisfactory grade of surface finish is achieved.

8. A method for finishing a shotgun barrel comprising the steps of:

swabbing the bore to remove dust;

inspecting the barrel bore to detect obstructions and blemishes;

securing the inspected barrel to a support structure in a horizontal orientation;

determining the grade of the surface finish of the bore;

connecting a polishing media pumping system to the receiver end of the barrel;

blocking all holes through the barrel wall;

pumping a silicone matrix media impregnated with silicon carbide from the receiver end of the barrel through the bore and out the muzzle end of the barrel to polish the bore until the bore striations are generally longitudinal;

disconnecting the barrel from the pumping system and the support structure;

cleaning excess media out of the bore;

removing all blocking materials from the barrel;

blowing air through the bore to clean out residue;

applying a liquid cleaner to the bore to remove oils and the like;

swabbing the bore;

determining the grade of the surface finish of the polished bore;

resecuring the barrel to the support structure; and repeating the previous steps as necessary until a satisfactory grade of surface finish is achieved.

9. A tapered shotgun barrel having a bore having gas transferring striations formed by polishing, and extending generally longitudinally therein.

10. A tapered shotgun barrel having a bore polished by pumping a silicon matrix media impregnated with silicon carbide from the receiver end of the barrel through the bore and out the muzzle end of the barrel until the bore has generally longitudinal gas transferring striations therein.

* * * * *